US005308078A

United States Patent [19]

Hatter

[11] Patent Number: 5,308,078

[45] Date of Patent: May 3, 1994

[54] AUTO RACING BOARD GAME

[76] Inventor: Gary Hatter, P.O. Box 1033, Mahomet, Ill. 61853

[21] Appl. No.: 13,323

[22] Filed: Feb. 4, 1993

[51] Int. Cl.[5] ..... A73F 300

[52] U.S. Cl. ..... 273/246

[58] Field of Search ..... 273/243, 246, 248, 249, 273/251, 252, 254

[56] References Cited

U.S. PATENT DOCUMENTS

| | | | |
|---|---|---|---|
| 2,470,632 | 5/1949 | McLeod | 273/252 |
| 2,823,919 | 2/1958 | Scruggs | 273/246 |
| 3,044,779 | 7/1962 | Hvizdash | 273/246 |
| 3,897,064 | 7/1975 | Sonnabend | 273/246 X |
| 4,624,463 | 11/1986 | Glennon | 273/246 |
| 4,890,842 | 1/1990 | Plange | 273/246 |
| 4,917,386 | 4/1990 | Tozer | 273/246 |
| 5,048,841 | 9/1991 | Manney et al. | 273/246 |
| 5,139,267 | 8/1992 | Trevisan | 273/246 |

*Primary Examiner*—William Stoll

*Attorney, Agent, or Firm*—Michael I. Kroll

[57] ABSTRACT

An auto racing board game is provided and consists of a game board and a plurality of playing pieces. The game board has a simulated race course thereon with a plurality of adjacent racing grooves. Each racing groove is divided into a plurality of sequential playing spaces, with a starting position, a halfway point stripe, a turn four stripe and a finish line. Each playing piece represents a player for movement along the race course from the starting position to the finish line.

3 Claims, 4 Drawing Sheets

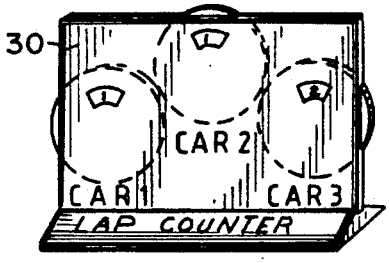
Fig. 5
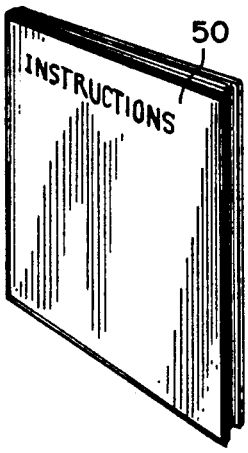
Fig. 6
Fig. 7
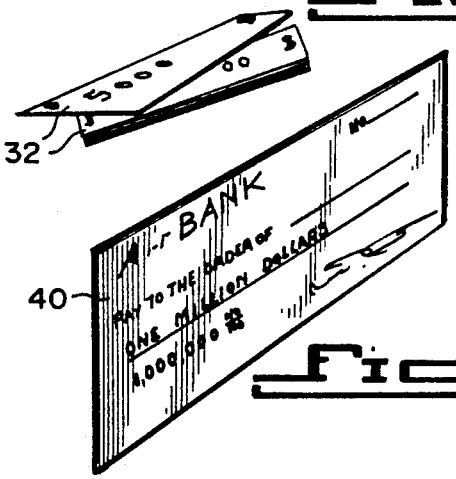
Fig. 7A
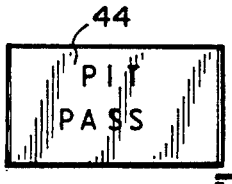
Fig. 8
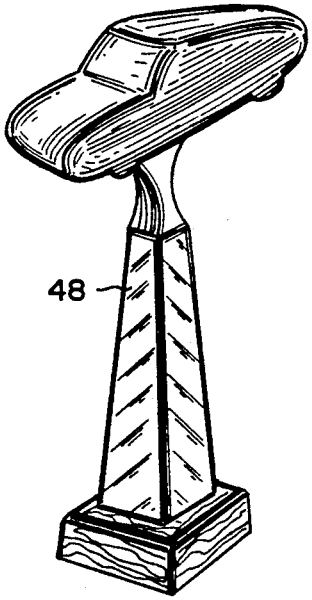
Fig. 9
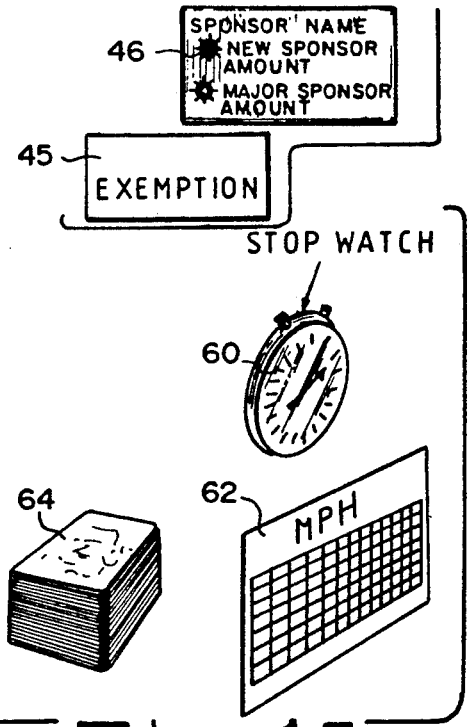
Fig. 10
(OPTIONS)

AUTO RACING BOARD GAME

BACKGROUND OF THE INVENTION

1. Field of the Invention

The instant invention relates generally to auto racing board game.

2. Description of the Prior Art

Numerous racing games have been provided in prior art that are adapted to be played upon game boards embodying racing themes. While these units may be suitable for the particular purpose to which they address, they would not be as suitable for the described.

SUMMARY OF THE INVENTION

A primary object of the present invention is to provide an auto racing board game that will overcome the shortcomings of the prior art devices.

Another object is to provide an auto racing board game that will give hours of excitement and fun to people playing the game.

An additional object is to provide an auto racing board game that will familiarize the public to auto racing and teach auto racing fans more about the sport.

A further object is to provide an auto racing board game that is simple and easy to use.

A still further object is to provide an auto racing board game that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 5 is a perspective view of the lap counter.

FIG. 6 is a perspective view of the instruction booklet.

FIG. 7 is a perspective view of the play money.

FIG. 7A is a perspective view of the million dollar check.

FIG. 8 is a plan view showing the pit pass card, one of the sponsor cards and one of the exemption cards.

FIG. 9 is a perspective view of the trophy.

FIG. 10 is a perspective view of various other optional items that can be used in the game, such as a stop watch, a selection of trading cards and an MPH chart.

DETAILED DESCRIPTION OF THE PREFERRED EMBODIMENTS

Figure 1:
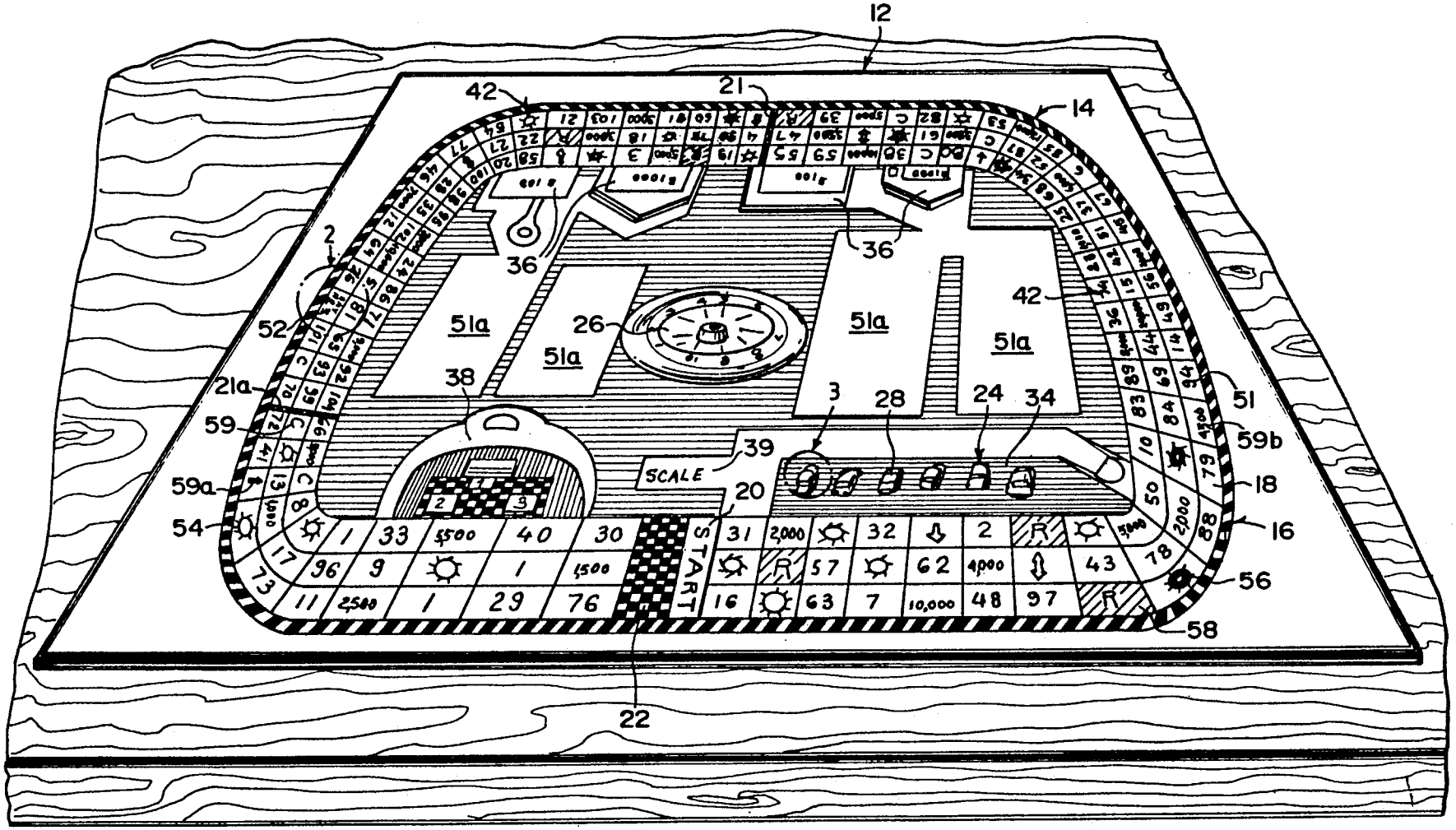
FIG. 1 is a perspective view of the game board placed upon a flat surface.

Turning now descriptively to the drawings, in which similar reference characters denote similar elements throughout the several views, the Figures illustrate an auto racing board game which consists of a game board 12, having a simulated race course 14 thereon, with a plurality of adjacent racing grooves 16. Each racing groove 16 is divided into a plurality of sequential playing spaces 18 and has a starting position 20, a half way point stripe 21, a turn four stripe **21*a* and a finish line 22. A plurality of playing pieces 24 are provided with each representing a player for movement along the race course 14 from the starting position 20 to the finish line 22**.

Figure 2:
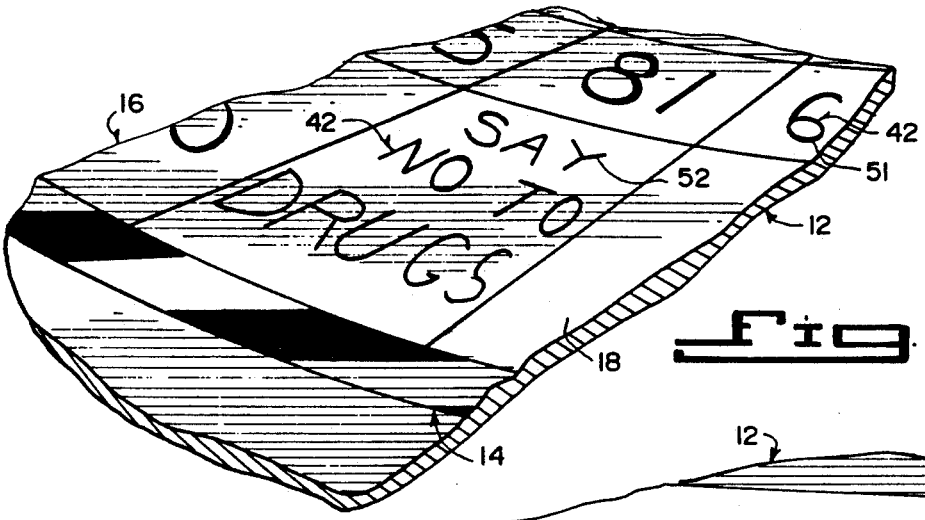
FIG. 2 is an enlarged perspective view of a portion of the game board as indicated by arrow 2 in FIG. 1, showing the "say no to drugs" space in greater detail.
Figure 3:
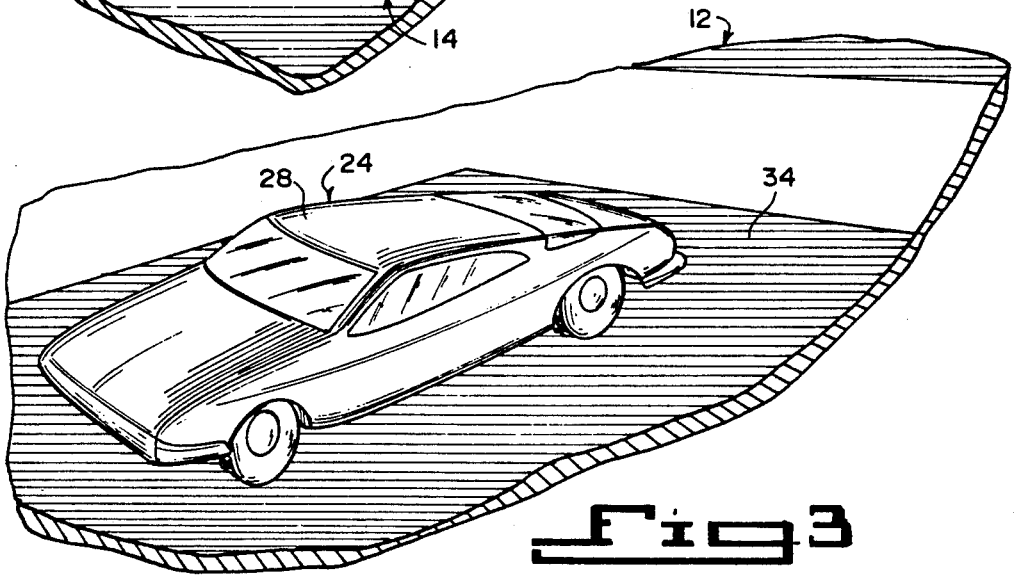
FIG. 3 is an enlarged perspective view of a portion of the game board as indicated by arrow 3 in FIG. 1, showing one of the mini race cars in greater detail.
Figure 4:
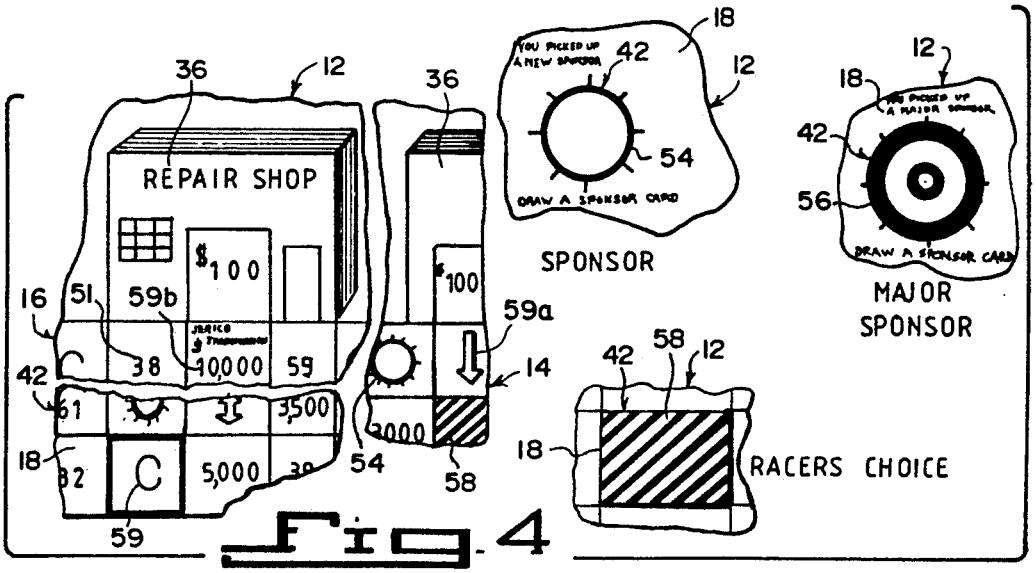
FIG. 4 is an enlarged plan view of various portions of the game board.
Figure 4A:
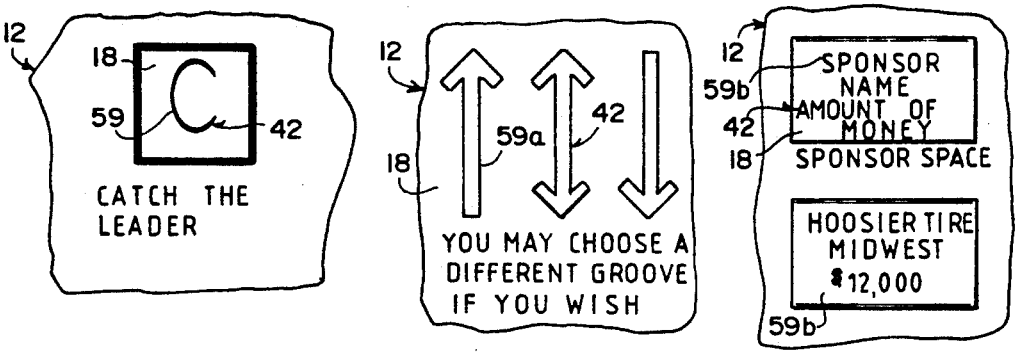
FIG. 4A is an enlarged plan view of other various portions of the game board.
Figure 4B:
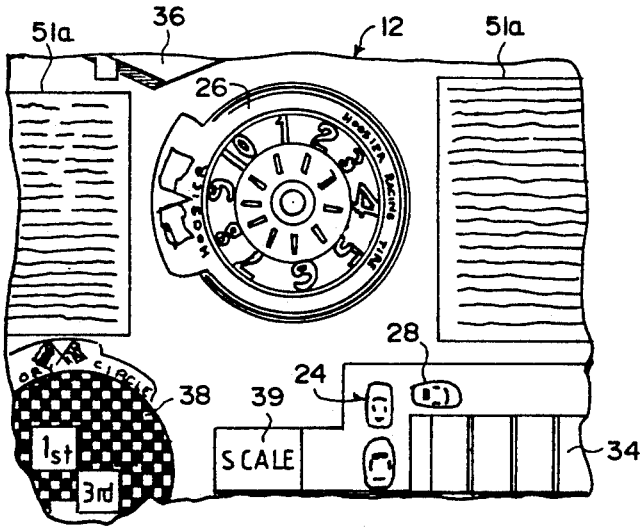
FIG. 4B AND 4C are enlarged plan views of still other portions of the game board.
Figure 4C:
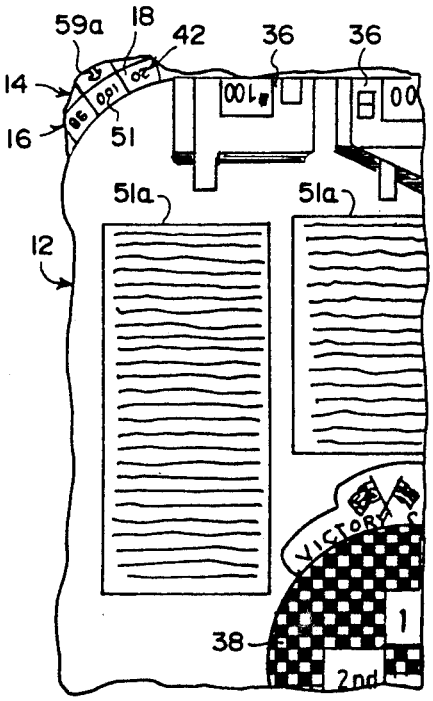
Figure 4D:
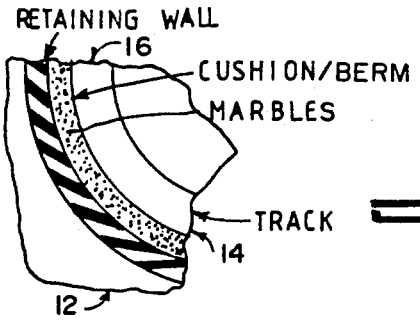
FIG. 4D is an enlarged plan view of a portion of the game board showing various parts of the track in greater detail.

A spinner 26 is for randomly choosing the movement of each playing piece 24 along the race course 14 on the game board 12. Each playing piece 24 is a mini race car 28, as best seen in FIG. 2. A lap counter 30, shown in FIG. 5, is to indicate the location of each mini race car 28 in its lap, along the race course 14 on the game board 12. Play money 32, shown in FIG. 7, is used during the play of the game for each player.

The game board 12 further contains a pit area 34, a plurality of repair shop locations 36 a victory circle location 38 and a scale location 39. A simulated check 40 for one million dollars, is presented to the player that wins the game at the victory circle location 38 on the game board 12. The game board 12 further includes indicia 42 located within each of the playing spaces 18 to provide information to each player for playing the game.

As seen in FIG. 8, a plurality of pit pass cards 44 are provided, in which two are given to each player, so that each can be used to enter the pit area 34 on the game board 12, during the play of the game. A plurality of exemption cards 45 are also provided, in which two are given to each player, so that each can be used to prevent a player from doing whatever the playing space 18 they land on indicates. A plurality of sponsor cards 46 are also used by each player, so that a sponsor can be chosen by each player during the play of the game. A trophy 48, shown in FIG. 9, is also presented to the player that wins the game at the victory circle location 38 on the game board 12. An instruction booklet 50, shown in FIG. 6, is to provide the rules of the game to each player.

Most of the indicia 42 in most of the playing spaces 18 on the game board 12 are a plurality of numbers as indicated by reference numeral 51 on the drawings, each corresponding to a list **51*a* on the game board 12**, indicating various things that can happen during the game.

The indicia 42 in one of the playing spaces 18 on the game board 12, as best seen in FIG. 2, are the words "say no to drugs" 52, so that when a player lands on that playing space 18 and says "I will always say no to drugs", the player will receive thirty thousand dollars of the play money 32. Some of the indicia 42 in some of the playing spaces 18 on the game board 12 are symbols 54 indicating new sponsors, so that a player must draw a sponsor card 46 and collect the amount of money the sponsor cards lists. Some of the indicia 42 in some of the playing spaces 18 on the game board 12, are symbols 56 indicting major sponsors, so that a player must draw a sponsor card 46 and collect the amount of money the sponsor card lists. Some of the indicia 42 in some of the playing spaces 18 on the game board 12, are symbols 58 indicating racers choices, giving the players four options. Some of the indicia 42 in some of the playing spaces 18 on the game board 12 are the letter "C" 59, indicating catch the leader. Some of the indicia 42 in some of the playing spaces 18 on the game board 12 are arrows **59*a* indicating that a player may choose a different groove 16. Some of the indicia 42 in some of the playing spaces 18 on the game board are words indicating a sponsor name and amount of money 59*b***.

The auto racing board game, as shown in FIG. 10, can further include a stop watch 60, a MPH chart 62 and a selection of trading cards 64, which could be utilized to introduce the game to the public.

Some of the indicia 42 in some of the playing spaces 18 on the game board 12 indicate a player must "Take a Chance". When landing on the playing space 18 that reads "Take a Chance", the player must move forward if an even number is spun an backwards if an odd number is spun. Buying additional spins for $20,000 of play money, allows a player to spin the spinner 26 and move several times consecutively during their turn.

People that are associated with racing knows it takes lady luck along with a lot of skill, hard work and knowledge to park their race car in victory circle after a hard fought battle with weather, track conditions, and a highly competitive field of drivers. Our game is designed to put you in the drivers seat giving you a chance to feel and experience the thrilling moments of picking up a major sponsor (that is extremely vital in today's racing) to the agony and financial hardships of blowing an engine. Your final goal is the most rewarding crossing the finish line first and tasting that precious moment of victory. This racing game is also designed in regards to all forms of racing, such as Stock Cars, Indy Cars, Formula 1, Sprint Cars, Midgets, Modifieds, Late Models, GTP Cars, Dwarf Cars, Go Karts, R/C Cars etc. just to name a few whether they race on dirt or asphalt.

Just like in real racing, this racing game is not limited to one form of movement. You can move forward, backwards, laterally, and diagonally throughout the entire race.

Players:

There are no limits as to the amount of players you may have in a race, although two to five players are highly recommended.

Laps:

There are no limits as to the amount of laps you race, although one to five laps are highly recommended.

Object of the game:

The first player to cross the finish line completing the designated number of laps the players choose to race is the winner and receives the gratifying honor of parking their race car in "Victory Circle". The winner also receives a large check in the amount of $1,000,000 along with a beautiful trophy. The second and third place finishers will also join the winner in "Victory Circle" for the victory celebration. (Note): If you're playing rule S-1, you will have to pass the scale inspection before going to "Victory Circle".

Rules:

You must choose someone to distribute the sponsor money and read the numbers on the board during the race. The longer you play the more familiar you'll become with the spaces making the race move along at a faster pace.

Each player receives two Pit Pass Cards (Explained in the Pit Pass Card section) and two Exemption Cards (Explained in the Exemption Card section).

You must qualify by spinning the wheel. The person that spins the highest number is the fastest qualifier and begins play in a clockwise manner.

The fastest qualifier will receive a $20,000 bonus at this time for earning the pole.

Anytime during the race you must spin the wheel all the way around at least once or you lose that spin.

A-1) A designated number of sponsor cards (depending on the number of laps and the number of players) will be dealt by the fastest qualifier at the beginning of the race. Each player will be dealt the designated number of Sponsor Card(s) and collect the Major Sponsor amount from each card. The fastest qualifier will deal one card at a time, starting with their self, in a clockwise manner until the designated number of cards are dealt.

A-2) Each player will be dealt one Sponsor Card by the fastest qualifier at the beginning of the race and collect the Major Sponsor amount from their card. The fastest qualifier will deal the cards, starting with their self, in a clockwise manner until the Sponsor Cards are dealt to each player.

A-3) Each player will be dealt five Sponsor Cards by the fastest qualifier at the beginning of the race and collect the Major Sponsor amount from each card. The fastest qualifier will deal one card at a time, starting with their self, in a clockwise manner until all five Sponsor Cards are dealt.

A-4) Each player will be dealt three Sponsor Cards by the fastest qualifier at the beginning of the race and collect the Major Sponsor amount from each card. The fastest qualifier will deal one card at a time, starting with their self, in a clockwise manner until all three Sponsor Cards are dealt.

You'll keep all your sponsor cards throughout the entire race and every time you land on your Sponsors Space on the race course, you will collect the Major Sponsor amount on the Sponsor Card.

Before the fastest qualifier begins play, by spinning the wheel, they must choose which groove they're going to start on. This applies to all players. If you spin the wheel and do not choose a groove you must spin over. You begin play by spinning the wheel and moving forward the correct number of spaces. Each space is marked with a number, symbol or a sponsor name and an amount of money. The space you land on will indicate what you must do.

The only time you would not do what a space indicates: After spinning the wheel you must move forward the correct number of spaces and do whatever the first space you land on indicates, but if that space allows you or sends you to a different space you are not allowed to do what the second space you land on indicates.

If you land on a space that requires you to pay an amount of money for repairs, you must pay the amount indicated. If you don't have enough money to pay for your repairs, you must go back to start and lose your next turn. You do not lose any of your laps you have already completed. When your turn rolls around again, you must choose a groove before you spin the wheel.

Anytime you land on a space that sends you backwards, the same rules apply as if you were moving forward, whether it's passing, blocking, etc.

Passing:

B-1) If you spin a number that allows you to pass another player that is on the same groove, you just simply jump over that opponent and keep going. If you land on a space that is occupied by an opponent you must take the next available space. This also applies when landing on a "Take a Chance" space that may send you backwards.

B-2) This rule will not allow you to jump over or pass another opponent, therefore, keeping the players on their toes and looking ahead throughout the race. If an opponent is ahead of you on the same groove, and you spin a number greater than the number of spaces you can move, you must move as far as possible and forfeit your remaining count. You must do whatever the space you land on indicates unless it sends you forward and since you're blocked you must remain where you are. If you land on a "Take a Chance" space and you spin an even number, you still have to pay the amount of money indicated on the space to repair your car even through you're not able to move forward.

B-3) This rule will not allow you to jump over another opponent, but will allow you to pass. When approaching another player to make a pass, you must use the groove next to the player you're passing. Once you've made the pass you must remain on that groove until your count is complete, unless you pass another opponent, in which case you must pass in the same manner.

If you land on a "Catch the Leader" space or a "Racer's Choice" space when playing this rule and you choose to catch the leader, make sure to drive your car around the race course because it may make a difference as to the groove you end up on, as you may be driving around other cars enroute to catching the leader. If you have a certain groove you would like to end up on, it may be possible depending on the route you choose.

B-4) This rule is exactly the same as rule B-3 with one exception. You are allowed to move back to the groove the player you passed in resting on. Example: If you're on the bottom groove and an opponent is occupying a space ahead of you, and you spin a number large enough to pass the opponent, you must use the groove next to the player you're passing (in this case the middle groove) to make the pass as in rule B-3, but in rule B-4 you have the option of moving back to the bottom groove before completing your count (providing the number you spun is at least one space further than the opponent you're passing).

Lap Money:

L-1) When the leader lands on or crosses the finish line they will collect a bonus of $10,000 from a sponsor, or L-2) draw a "Sponsor Card" and collect the Major Sponsor amount. This money will be paid out each lap to the person who is leading.

Halfway Point Money:

H-1) The first person to cross the stripe at the halfway point of the race will collect a $50,000 bonus from the halfway point sponsor. Once a player crosses the halfway point stripe and collects the $50,000 bonus, it doesn't matter if they land on a space that sends them back past the halfway point stripe, they still keep the $50,000 for crossing the halfway point stripe first. This money is only paid out once during a race.

H-2) Exactly the same rules as H-1 with one exception. Instead of collecting $50,000 you would draw a sponsor card and collect the Major Sponsor amount.

Note: If you decide to race an even amount of laps, the finish line will determine the halfway point. Example: Lets say you're having a four lap race, the first player to land on or cross the finish line on lap 2 will collect the halfway point sponsor money.

Changing Grooves:

There are several ways you can change grooves. 1) If you land on a space that reads "You may choose a different groove if you wish", 2) If you land on a space that reads, "You must choose a different groove", 3) You land on a "Racer's Choice" space and wish to choose a different groove, 4) You land on a "Catch the Leader" space or a "Racer's Choice" space and you choose to catch the leader, and the leader happens to be on the same groove, you must move to the groove next to the leader, or 5) You're playing rule C-1 or C-2.

C-1) Anytime throughout the race, when it's your turn, you may pay $5000 and move laterally to another groove before you spin the wheel.

C-2) The same as rule C-1 except you don't have to pay the $5000.

If you're playing rule B-1 in conjunction with rule C-1 or C-2 and an opponent is resting on a space next to you, you may simply move ahead of that opponent. If you have to jump an opponent to change to a different groove you may do so when playing rule B-1.

If you're playing rule B-2, B-3 or B-4 in conjunction with rule C-1 or C-2 and an opponent is resting on a space next to you, this will prevent you from changing to that groove since the opponent has you blocked.

If you land on a space such as 75, 80, 82, 85 or 88 playing rule B-2, B-3 or B-4 and another player is beside you occupying the space you're supposed to end up on, you must remain where you are since you're not allowed to jump over an opponent. If you land on space 85 on the high groove and another player is occupying space 34 on the bottom groove, you must move to space 52 on the middle groove. You always move as far as possible.

There are some numbered spaces you'll land on that will allow you to move diagonally simulating the actual movement of a car in that particular situation.

If you land on space 89, you will slide across 44 to space 49.

If you land on space 86, you will slide up to space 81.

If you land on space 84, you will slide up to space 94.

If you land on space 81, you will bounce up to space 101.

If you land on space 73, you will bounce across 96 to space 33.

If you land on space 34, you will slide across 87 to space 53.

If you land on space 92, you will veer across 99 to space 72.

If you land on space 58, you will cross 27 to space 77, then across 28 to space 95.

Crashes:

Nobody in racing likes to crash, but it happens and our game is no different. There are spaces you'll land on indicating the car isn't handling properly such as 34, 58, 73, 81, 84, 86, 89 and 92. If you land on one of these eight spaces and an opponent is resting on a space you have to cross or the space you have to end up on, this will result in a crash. Everyone involved in the accident must go to the Pit Area and spin the wheel to determine how much damage you received in the pile up and what it will cost for repairs. Each player involved in the accident must pay $1,000×the number they spin to repair the damage. If you have the money you must pay for repairs, otherwise you will lose your next turn. You are not allowed to use an "Exemption Card" if you're involved in a crash with another player. You must pay the $9,000 for landing on space 58 and the $200 for landing on space 92 in addition to the cost of the accident.

Mechanical Problems:

There are numbered spaces around the race course that will read "Take a Chance". The majority of these problems are mechanical and can occur to race cars just about anytime throughout a race, and with a little luck you can still finish and possibly taste that glorious moment of victory. If you spin an even number you must pay the amount listed on the space to repair the problem and move forward the number of spaces on the wheel. If you don't have the money to pay for your repairs, you must go back to start and lose your next turn. You do not lose any of your laps that you have already completely. When your turn rolls around again you must choose a groove before you spin the wheel. If you spin an odd number on the wheel the problem is not fixed and it's slowing you down. You must go back the number of spaces on the wheel.

Blocking:

There is no blocking in rule B-1, if you're playing rule B-1 disregard this section.

If you're playing rule B-2 and another player is resting on a space ahead of you, and you spin a number greater than the number of spaces between you and the other player, you must move as far as possible and forfeit your remaining count since you're blocked.

If you're playing rule B-3 or B-4, it is possible to form a block with as few as three players. Example: The only way this will happen is if you're on the bottom groove or the high groove and two players are sitting side by side on the race course. In this situation you must move forward as many spaces as you can and forfeit your remaining count. You must do what the space you land on indicates unless it sends you forward and since you're blocked you must remain where you are. If it would happen to be a "Take a Chance" space and you spin an even number you still have to pay the amount of money indicated on the space to repair your car even though you're not able to move forward. If you're in this situation and it's your turn to spin, there is only one way you would be able to pass, if you're playing rule C-1 or C-2 allowing you to change grooves before you spin, otherwise you will remain blocked and must lose your turn.

If the same situation happened as described above (four or more players only) and there is another player sitting on the middle groove next to you, you would be totally blocked, therefore losing your turn.

You may run into a situation if your playing rule B-2, B-3 or B-4 (four or more players only) where each groove is occupied at the same point on the race course by other players thus forming a block. If this should happen, you must move forward as many spaces as you can and forfeit your remaining count. You must do whatever the space you land on indicates unless it sends you forward and since the track is blocked you must remain where you are. If you landed on a "Take a Chance" space and spin an even number, you still have to pay the amount of money indicated on the space to repair your car even though you're not able to move forward.

If you land on a "Catch the Leader" space or a "Racer's Choice" space and choose to catch the leader playing rule B-2, B-3 or B-4, and run into a situation while driving around the race course where there is a block, you must move as far as possible and remain behind the block. The only way this will happen playing rule B-3 or B-4, is if you're on the bottom groove or the high groove and two players are sitting side by side or all three grooves are occupied by other players. This will prevent you from "Catching the Leader". Make sure and study the route before moving when trying to "Catch the Leader" because you may be able to avoid a two groove block. Refer to the Pit Area and Repair Shop section for more blocking information.

Pit Area and Repair Shops:

When coming out of the Pit Area or one of the four Repair Shops you may move across the race course laterally to the groove of your choice counting each space as you go. Once you've reached the groove of your choice, you must turn and move forward finishing your remaining count. For Example: If you're in the Pit Area and spin a six, you have a choice of landing on space 2 on the bottom groove, space 62 on the middle groove or space 7 on the high groove. On the other hand if you were to spin a 1, you must move to space 31. You must once again move forward on your next spin.

If the leader is in the Pit Area or one of the four Repair Shops and another player lands on a "Catch the Leader" space or a "Racer's Choice" space and chooses to catch the leader, and you're playing rule B-1 or B-2 you must stay on the same groove stopping on the space even with the leader. If you're playing rule B-3 or B-4, you must drive your car around the race course passing any cars that may be on the same groove until you have reached a space even with the leader. Note: Keep in mind when passing other players, you may have a choice as to the groove you end up on, depending on the route you to end up on, it may be possible, so study the route before you move your car around the race course.

If you're in the Pit Area or one of the four Repair Shops, you may choose any groove when coming out onto the race course as long as the number you spin will allow you to do so.

If you're playing rule B-1 and an opponent is on the bottom groove at the entrance, the player in the Pit Area or one of the four Repair Shops must move to the bottom groove unless another player is resting on that space. This would give you the option of moving ahead of the car on the bottom groove or move up to the middle groove. Regardless of the groove an opponent's on, you may jump over them and land on the next available space.

If you're playing rule B-2, B-3 or B-4 and an opponent is on the bottom groove at the entrance, the player in the Pit Area or one of the four Repair Shops is blocked, and since you can't jump an opponent, you must lose your turn. If an opponent is on the middle groove at the entrance, the player in the Pit Area or one of the four Repair Shops must use the bottom groove and if an opponent is on the high groove at the entrance, the player in the Pit Area or one of the four Repair Shops has the option of using the bottom groove or the middle groove providing the number you spin will allow you to do so.

If you are in one of the four Repair Shops you must pay your repair bill before entering back onto the race course. Your repair bill is determined by the number you spin times $100 or $1,000 depending on the shop you're in. Example: It cost you $1,000 times the number you spin to get out of a Repair Shop. If you spin a 7 it costs you $7,000 and so on. If you have the money you must pay your repair bill. Once your repair bill is paid you must move your car forward the number of spaces indicated. In this example you would move forward seven spaces. You may choose any groove when coming out of the Repair Shops as long as the rules you are playing and the number you have spun will allow you to do so.

If you don't have the money to pay your repair bill you must go back to start and lose your next turn. You do not lose any of your laps that you have already completed. When your turn rolls around again you must choose a groove before you spin the wheel.

F-2) If you're in a repair Shop, and you have that Repair Shop Sponsor Card, you are exempt from paying the repair bill. In other words you do not have to pay your repair bill, the sponsor writes it off.

Buying Additional Spins:

A player can pace their self while traveling around the race course or open the throttle and let it rip and still have additional acceleration when they need it. Anytime throughout the race you may pay $20,000 for an additional spin (providing the rules you're playing will allow you to do so) allowing you to accelerate around the race course. You must pay the $20,000 before you spin the wheel. If you don't pay before spinning the wheel, you must wait until your next turn before you can buy any additional spins. If your not leading the race, you may buy as many additional spins as you wish allowing you to put the hammer down and accelerate around the race course in pursuit of the leader.

Here are the rules and limitations pertaining to the leader when buying additional spins: Note for rule G-2 and G-5: If you still have a spin remaining and land on a space that sends you backwards, in turn giving the lead to another player, you may once again buy as many additional spins as you wish until you catch the leader.

(G-1) If you're the leader of the race you may not buy any additional spins.

(G-2) If you're leading the race you may buy one additional spin per turn.

(G-3) If you're the leader of the race you may buy as many additional spins as you wish.

This section of buying additional spins applies to any player that is leading the race between the halfway point stripe and the finish line on the final lap of the race:

(G-4) The leader of the race may not buy any additional spins if they're between the halfway point stripe and the finish line on the final lap.

(G-5) The leader of the race may only buy one additional spin per turn if they're between the halfway point stripe and the finish line on the final lap.

Turn 4 Stripe:

T-1) Anytime you cross the turn 4 stripe on the final lap, you are not allowed to buy anymore additional spins. If you choose to go to the Pit Area or you are sent back past the turn 4 stripe, you may once again buy additional spins (providing the rules you're playing will allow you) until you cross the turn 4 stripe once again. In other words, you may not buy any additional spins as long as your race car is on a space between the turn 4 stripe and the finish line on the final lap.

Keep in mind after you get through paying for any additional spins you still have your original spin remaining. If you would happen to pay for a spin and land on a space that reads: Lose your next turn, this will prevent you from buying anymore additional spins until your next turn since you have now lost your original spin ending this turn. Since you have already lost your original spin, you will get to spin the wheel once again when it comes back around to your turn. It may not seem like your losing your turn because you paid for a spin, but actually the spin you paid for was all you were able to use, and you did in fact lose your original spin you had coming to you.

P-1) As long as a player is resting on a space between the Turn 4 Stripe and the Finish Line on the Final Lap, no one is permitted to use a Pit Pass Card. If you're quite always behind the leader and don't think you have enough money to catch up, make sure to use your Pit Pass Card(s) wisely and at the precise time to try and catch the leader, before a player crosses the Turn 4 Stripe on the Final Lap.

Crossing the finish line:

The race is over when a player crosses the finish line completing the designated number of laps the players choose to race.

Using the Scale:

S-1) The unofficial winner will line up on the scale. The player that is in the second position on the race course will line up next and so on. There is one question yet to be answered, will the winning car weigh enough and take home the victory or get disqualified for being too light? The way this is determined, the player that finished second will pick a number. The unofficial winner will spin the wheel (the wheel must go all the way around at least once) and if that number does not come up they are declared the winner. If the number does comes up the unofficial winner weighed in too light and is disqualified. In either case the player that finished second must pull on the scale and go through the same procedure. The player that finished third must pick a number and so on until everyone has weighed. Once you have determined the first, second and third place finishers, the remaining players do not need to weigh unless you're playing for points.

If for some miraculous reason all the cars weighed in too light and are disqualified, the players would be granted the position they finished the race before going to the scale. This may happened more often in a two player race, but would still be considerably rare.

S-2) If you're playing this rule, you would not use the Scale and therefore the first player to cross the finish line would be the official winner. The remaining positions would be determined according to the location of the remaining players on the race course.

If there would happen to be a tie for a position when the race is over, the players that are tied will spin the wheel one time (in the order of their turn), (unless a player is blocked or has to lose their turn, therefore giving up their tie breaking spin) and move forward the number of spaces on the wheel. The players must do whatever the space they land on indicates. This should break the tie, if not, repeat until the tie is broken.

If a tie would happen to occur and the first player to spin the wheel would cross the finish line completing their final lap, they automatically get that position.

"Catch the Leader":

Your car is hooked up and hummin' by far the fastest on the race course at this point. If you land on a space marked with a "C" you may catch the leader. If you are the leader, then move forward fifteen spaces.

"New Sponsor":

D-1) Draw a Sponsor Card to find out who your New Sponsor will be and then "Spin the Wheel" to find out how much money your New Sponsor is giving you. Collect $1,000×the number you spin. Example: If you spin a 5 collect $5,000.

D-2) Draw a sponsor Card to find out who your New Sponsor will be and collect the New Sponsor amount.

No matter if you're playing rule D-1 or D-2, you'll keep this Sponsor Card throughout the race and every time you land on your Sponsors Space on the race course you will collect the Major Sponsor amount.

"Major Sponsor":

It finally paid off! You've picked up a new Major Sponsor giving you that extra cash it takes to win.

E-1) Draw a Sponsor Card to find out who your new Major Sponsor will be. At this time you have two choices: 1) If you feel lucky spin the wheel one time and collect three times the number×$1,000 Example: You spin an 8 collect $24,000; 2) Spin the wheel three times adding up each spin×$1,000 Example: If you spin a 3, 7 and 8 you will collect $18,000.

E-2) Draw a Sponsor Card to find out who your new Major Sponsor will be and collect the Major Sponsor amount.

No matter if you're playing rule E-1 or E-2, you'll keep this Sponsor Card throughout the race and every time you land on your Sponsors Space, you will collect the Major Sponsor amount.

"Sponsor Space":

This sponsor is giving you more money to help bring home a victory. These are the spaces on the race course that are marked with a sponsor name and an amount of money. If you land on these spaces during the race simply collect the amount of money indicated, but if you're holding the Sponsor Card indicating this is your Major Sponsor, you'll collect the Major Sponsor amount.

"Racer's Choice":

This space gives you four options: 1) Catch the Leader (Except on the final lap when the leader is resting on a space between the Turn 4 Stripe and the Finish Line. If a player lands on a Racer's Choice space, they must drive their car around the race course passing any cars along the way that may be in their lane. Once they're on the same lap as the leader, they must stop on the last space in turn 4 marked with a "C" on their groove. If the space marked with a "C happens to be occupied by another player, they must move to the next groove and make the pass stopping even with the opponent. This applies to all grooves. It is possible to land on a Racer's Choice space and pass the leader on the final lap, providing the leader is only one or two spaces beyond the Turn 4 Stripe on the middle groove or the high groove and you move up to the space marked with a "C" on the bottom groove. This is the only way you can land on a Racer's Choice space and pass the leader anytime during a race without moving forward 15 spaces), 2) Move forward fifteen spaces, 3) Pick up a New Sponsor. Draw a Sponsor Card and if you're playing rule D-1 spin the wheel and collect a $1000×the number you spin or if you're playing rule D-2 collect the New Sponsor amount listed on the Sponsor Card or 4.) You may choose a different groove if you wish.

If you land on the "Say NO to Drugs" space, you must say these words: "I will always Say NO to Drugs" in order to collect the $30,000.

"Exemption Cards":

Each player is dealt two Exemption Cards at the beginning of the race. If you land on any numbered space, you are exempt from doing anything the space indicates if you turn in an Exemption Card. If you land on a space that reads "Take a Chance" you must decide before spinning the wheel if you're going to use an Exemption Card. You are not allowed to use an Exemption Card to pay your repair bill when coming out of a repair shop or if you're involved in a crash with another player.

"Pit Pass Cards":

In auto racing you must have a Pit Pass in order to be in the Pit Area. Each player is dealt two Pit Pass Cards at the beginning of the race. You may want to turn in a Pit Pass Card before you spin the wheel allowing you to go to the Pit Area anytime during the race for any number of reasons.

There are only 2 ways you're not allowed to use a Pit Pass Card: 1) If you're playing rule P-1 and a player is resting on a space between the Turn 4 Stripe and the Finish Line on the Final Lap and 2) If you're in a Repair Shop and do not have that Repair Shop Sponsor Card. Note: If you have the Sponsor Card for the Repair Shop you're in, you may use a Pit Pass Card.

"Races":

Since this racing game is versatile to fit virtually all types of racing and enables you to put together any number of combinations to form your own race, I've found the best combination of rules that are as close to real racing as possible are rules A-3, B-4, C-2, D-2, E-2, F-2 G-2, H-1, L-2, S-1 and T-1 along with the standard rules. This combination of rules is highly recommended for any race. It is also recommended to have a Feature race of two, three, four, or five laps although more or less laps may be ran if the players choose to do so.

You may want to race a very fast one lap Feature with these rules: A-3, B-4, C-2, D-2, E-2, F-2, G-2, S-1 and T-1 along with the standard rules.

You may want to race a quick two lap Feature with these rules: A-3, B-4, C-2, D-2, E-2, F-2, G-2, H-1, L-2, S-1, and T-1 along with the standard rules.

You may want to race a one lap Trophy Dash with these rules: A-3, B-4, C-2, D-2, E-2, F-2, G-2, S-2, and T-1 along with the standard rules. You are not allowed to use any Exemption cards in a one lap Trophy Dash.

You may want to race a two lap Heat Race with these rules: A-3, B-4, C-2, D-2, E-2, F-2, G-2, S-1, and T-1 along with the standard rules. You're only allowed to use one Exemption Card in a two lap Heat Race.

"Common Racing Program Formats"

1) Qualify, and a Feature.
2) Qualify, Heat Race and a Feature.
3) Qualify, Trophy Dash, Heat Race and a Feature.

Some of the races listed go by different names such as: The Trophy Dash may be called a Dash for Cash, The Heat Race may be called a Qualifier Race, The Feature Race may be called an A-Main. These are just a few of the races that are the same but may go by a different name.

"Setting up a racing format with or without points":

You can put together your own racing program or use one of these common formats promoters use at race tracks all over the world.

Regardless of the format you choose, the rules will remain the same. The fastest Qualifier receives $20,000 and begins the race. The winner of the Trophy Dash collects a $10,000 bonus to start the Heat Race and begins play. If your format doesn't include a Trophy Dash, the fastest Qualifier will begin play in the Heat Race. The winner of the Heat Race collects a $20,000 bonus to start the Feature and begins play. If your format doesn't include a Heat Race, the fastest Qualifier will begin play in the Feature. Each player starts the first race in the order they qualified in a clockwise manner. If your format has more than one race in it, you'll always start the next race according to how you finished the previous race. The first, second and third place finishers in the Feature will go to Victory Circle. It is highly recommended to have a two, three, four or five lap Feature race, although more or less laps may be ran if the players choose to do so.

"Championship Points":

You may also want to keep track of points to find out who the points Champion will be. You can set up your own point system or use the one listed below.

Fast Qualifier: 25 points, and an additional 25 points if they can win the feature.

Trophy Dash: 1st Place 40 points, 2nd Place 30 points, 3rd Place 25 points, 4th Place 20 points and 5th Place 15 points.

Heat Race: 1st Place 60 points, 2nd Place 50 points, 3rd Place 40 points, 4th Place 35 points and 5th Place 30 points.

Feature: 1st Place 100 points, 2nd Place 80 points, 3rd Place 70 points, 4th Place 60 points and 5th Place 50 points.

Bonus Points in the Feature: 20 points for leading a lap, 25 points for leading at the halfway point of the race and 20 points for leading the most laps including the final lap. If there is a tie for leading the most laps, all the players tied will receive 20 points each.

If you get disqualified at the scale you get 0 points for that race.

Helpful Hints:

Keep one thing in mind, without sponsors you don't have the money it takes to be competitive, and in the sport of auto racing the more money you have to work with the better your chances will be of bringing home a victory.

Collect as much money as possible so you can buy more additional spins throughout the race. These additional spins will allow you to accelerate at a faster pace around the race course when you need to. Timing is extremely important in all types of racing deciding when to make that crucial move at the precise time in pursuit of picking up the lap money, the halfway point money or even the victory. There are three very important keys that will help you dramatically to achieve this goal. 1) Buying Additional Spins 2) Pit Pass Cards 3) Exemption Cards. Once you have learned how to use these three keys separately or in conjunction with each other, your chances of winning will increase. It's better to have a little extra money left when the race is over than to run out during the race. Running out of money could very easily hurt your chances of winning the race. Just like in real racing, this game usually boils down to the final lap and you'll learn fast how to use your money, pit pass cards and exemption cards to set up a winning strategy.

If you get too far behind during the race, you may want to try and land on a space that will allow you or send you to the pit area, since you have an excellent chance of catching the leader from the pit area. If you spin a 3, 7 or 10 when coming out the pit area, you have the option of landing on a "Racer's Choice" space that will allow you to catch the leader. If you spin a 4, 5, 6 or 8, you will have the option of landing on a space that will send you back to the pit area giving you another chance to catch the leader on your next spin. There are only three numbers that will work against you when coming out of the pit area. If you spin a 1, 2 or 9 you're forced to land on a space that will not allow you to go back to the pit area. Keep in mind, you still have the option of turning in a pit pass card that will allow you to go to the pit area. If you're quite always behind and the leader is about to win the race, using the pit area strategy along with your pit pass cards, exemption cards and buying additional spins, you can actually come from behind and surprise your competition with an impressive win.

It's a good idea to try and hold on to your pit pass cards and your exemption cards as long as possible, because you may need them to help you win the race.

Passing Tip: If you're playing rule C-1 or C-2 that allows you to change grooves before you spin the wheel, in conjunction with rule B-3 or B-4, you can actually set up a strategy when you're behind another player, giving you a chance to use more than one groove, thus upping your chances of landing on an excellent space.

LIST 51A OF NUMBERS 51 ON THE GAME BOARD 12 AND THEIR MEANING

1) Your Engine Blew scattering parts all over the Track "Pay $17,500 or go to pit area and lose your next turn".
2) Broke a Rocker Arm "Pay $700 or Go back 5 spaces."
3) Fuel pressure dropped indicating you're running Low on Fuel "Take a Chance" if you spin an even number go to Pit Area and Fuel your Machine.
4) The Turbo Boost kicked in adding extra horsepower to the engine making your car extremely fast "Go forward 12 spaces."
5) Your Tires are starting to go away "Go to Hoosier Tire Midwest".
6) Broke an Axle "Pay $500 or go to Pit Area."
7) Busted a Brake Caliper "Pay $200 and Go back 3 spaces."
8) The Rear End Locked up "Pay $1,400 and lose your next turn."
9) The Tail Shaft twisted off the rear of the Transmission "Pay $1,700 and lose your next turn."
10) You lost your Drive Shaft "Pay $800 or Go back 10 spaces."
11) Transmission Locked Up "Pay $2,000 or lose your next turn."
12) Your Tire Compound is too soft "Go to Hoosier Tire Midwest."
13) Burned a Bearing in the Engine causing the Engine to lock up "Pay $11,000 and lose your next turn."
14) Busted the Center out of a Wheel "Pay $700 or Go back 7 spaces."
15) Water pump is Leaking "Take a chance" if you spin an even number pay $200.
16) Gear Box Linkage Jammed "Pay $1,800 or lose your next turn."
17) Dropped A Valve "Pay $5,500 or go to Pit Area and lose your next turn."
18) You ran over a piece of busted Bell Housing cutting down a Tire "Go back 9 spaces and pay $200 for a new Tire or Go to Pit Area."
19) Broke a Push Rod in the Engine "Pay $2,500 or Go to Pit Area."
20) Engine is Fluttering "Go to Dependable Carburetor Rebuilders."

21) Engine Running too Lean "Go to Dependable Carburetor Rebuilders."
22) Engine Running too Rich "Go to Dependable Carburetor Rebuilders."
23) The Quick Change Rear End is leaking grease and starting to smoke "Take a Chance" if you spin an even number pay $1,800.
24) Engine is Overheating "Take a chance" if you spin an even number pay $2,000.
25) Wheel Bearing is Loose "Take a Chance if you spin an even number pay $500 for repairs.
26) Your right rear Shock Absorber is bent "Take a Chance" if you spin an even number pay $300 for repairs.
27) One of the Header pipes developed a crack causing the engine to run rough "Take a Chance"if you spin an even number pay $300 to replace both Headers.
28) The rear Torsion Bar broke "Go to Pit Area and Pay $400."
29) Your Crankshaft broke "Pay $8,000 or go to Pit Area and lose your next turn."
30) Burned a Piston "Pay $6,500 or go to Pit Area and lose your next turn."
31) Clutch is slipping "Pay $1,700 or lose next turn."
32) Harmonic Balancer exploded "Pay $1,300 or lose your next turn."
33) A Radiator Hose popped "Pay $100 and go back 3 spaces."
34) The bottom is extremely Dry Slick preventing you from holding a tight line "Move across 87 to space 53."
35) Busted a Brake Line causing you to lose your Brakes "Take a Chance" if you spin an even number pay $200.
36) Your Tires dug in causing the Car to Bicycle "Take a Chance."
37) Your car is loose and will not handle "Go to Pit Area and adjust the Wedge."
38) You picked up a rock from the race track puncturing a hole in the Radiator "Go to pit area and pay $300 for repairs."
39) A couple of teeth sheared off the Distributor Shaft "Go to Pit Area and pay $500 to replace the Distributor."
40) Your Camshaft broke in the engine "Pay $7,000 or go to Pit Area and lose your next turn."
41) You busted a right rear Leaf Spring and Shock Absorber "Pay $1,000 for repairs."
42) The engine fouled a Spark Plug "Take a Chance" if you spin an even number pay $100 for a new set of Plugs.
43) You busted a right rear Axle Tube "Pay 400 or Go back 7 spaces."
44) You just did a 360 degree spin "Go back 8 spaces."
45) You ran over the Berm ripping a hole in the Oil Pan "Pay $2,000 for repairs or go to Pit Area."
46) Cracked a Cylinder Head "Pay $1,500" and "Take a chance." If you spin an even number the damage is worse then expected "Pay an additional $1,500 for repairs."
47) The Valve Cover Gasket on the right bank is Leaking Oil "Take a Chance" if you spin an even number pay $200.
48) Magneto went dead "Go to Pit Area and pay $600 for a new Magneto"
49) Your car is Leaking Fuel "Go to Pit Area and check it out."
50) The Power Steering hose popped making your race car extremely hard to steer "Go to Pit Area and pay $200 for repairs."
51) The left rear drive flange stripped out causing your race car to get extremely squirrelly "Pay $200 or Go back 8 spaces."
52) You're Burning up the Tires "Take a Chance" if you spin an even number "Pay $800 for a new set of Hoosier Tires.
53) The Hood flew up blocking your view "Go to Pit Area and put in new hood pins."
54) An oil line busted causing your engine to erupt in a ball of fire "Go to Pit Area and pay $1,200 for repairs."
55) Lost your Oil Pressure "Go to Pit Area and check it out."
56) Your right front wheel caught the Berm knocking the Toe out of alignment "Take a Chance" if you spin an even number pay $100.
57) You are black flagged because of a Leaking Oil filter that's throwing oil all over the racing surface "Go to Pit Area and replace your Oil Filter."
58) The Steering U-Joint busted causing your car to sail across 27 to space 77 where it slammed the wall head on. After the impact your car slid across 28 to space 95 "Go to Pit Area and pay $9,000."
59) The track is tacky and fast but it's hard on the engine "Take a Chance" and "Triple your spin."
60) The track is tacky and fast but it's hard on the engine "Take a Chance" if you spin an even number "Double your Spin" and if you spin an odd number "Triple your Spin."
61) The track is tacky and fast but it's hard on the engine "Take a Chance" if you spin an even number "Triple you Spin" and if you spin an odd number "Double your Spin."
62) Your car Burst into Flames "Go to Pit Area and pay $2400 to repair the damage."
63) You blew a Head Gasket and the white smoke is pouring out "Go to Pit Area and pay $2,000 to repair damage."
64) Popped the cushion too hard and blew out Right Rear Tire "Go back 5 spaces and pay $200 for a new Tire."
65) You hit a nasty rut in turn 4 busting the Right Rear Bird Cage "Go to Pit Area and pay $1,000 for repairs."
66) Fuel Pump Belt came off "Go to Pit Area and lose your next turn."
67) Jumped the cushion and hit the turn 2 wall rupturing your Fuel Cell "Go back 8 Spaces and pay $800 for a new Fuel Cell."
68) You jumped on the throttle too hard coming out of turn 2 breaking the rear tires loose "Go back 3 spaces."
69) You nailed a pot hole causing the car to flip upside down "Go to Pit Area and lose your next turn."
70) You lost control and crashed hard into the turn 4 wall busting the upper A-Frame, Ball Joints, Spindle, Rotor, Caliper, Hub, Wheel, Tie Rod and the Rack "Go to Pit Area and pay $4,000."
71) You busted a coil over Shock "Pay $200 and go back 4 spaces."
72) You made contact with the turn 4 wall causing the lower Control Arm to pull out of the frame "Go back 4 spaces and pay $500."

73) You smacked the Front Stretch Wall knocking you to the bottom groove "You must move across 96 to space 33 on the bottom groove."
74) You spun Out "Go back 12 spaces."
75) Gear set up is too high "Move to the high groove."
76) Your car stalled with Ignition Problems "Lose your next turn."
77) You drove in a little too hard and nailed the turn 3 wall busting a Tie Rod End "Go back 9 spaces and pay $100."
78) The weight distribution is perfect giving you a fast combination that's allowing you to fly through turn 1 with both feet flat on the floor "Move forward 10 spaces."
79) The car is handling perfectly against the cushion through turn 1 "Move forward 5 spaces."
80) Gear set up is too high "Move to the middle groove."
81) You hooks a rut bouncing you up to the high groove "Move up to space 101."
82) Gear set up is too low "Move to the middle groove."
83) You found your rhythm and the race car is dialed in perfectly allowing you to stand on the gas through turn 1 "Move forward 9 spaces."
84) You jumped on the binders too hard causing the car to brake push "Move up to space 94 on the high groove."
85) Gear set up is too low "Move to the low groove."
86) Your race car is extremely tight causing the front end to push "Move up to space 81 on the middle groove."
87) Blistered a Tire "Take a Chance" if you spin an even number pay $200 for a new Tire.
88) Your car is not set up for the high groove "You must choose a different groove."
89) Your car went into a 4 wheel drift "Move across 44 to space 49 on the high groove."
90) Debris flew in the Turbo Charger causing it to lock up "Pay $2,200 and lose your next turn."
91) The Gear set up is perfect giving you maximum top end speed "Go forward 9 spaces."
92) The right front Tire blew causing your car to veer across 99 to space 72. Move to space 72 and Pay $200 for a new tire."
93) Clipped the Edge of a Rut causing you to get out of shape "Go back 5 spaces."
94) Went to high and got in the Marbles "Go back 3 spaces."
95) Your tire stagger is on the money allowing you to fly through turn 3 "Go forward 7 spaces."
96) Lost a Cylinder "Pay $7,500 or go to Pit Area and lose your next turn."
97) Your car is hooking up and getting faster through the turns as the track is starting to come around "Go forward 10 spaces."
98) Your chassis set up is perfect for the track condition allowing you to fly through turn 3 without lifting "Move forward 9 spaces."
99) You Hit a nasty hole in the middle groove causing your car to flip several times landing upside down "Go to MasterSbilt".
100) The right rear Axle sheared off causing your race car to flip violently in turn 3 "Go to MasterSbilt."
101) Hooked the cushion sending your machine into a series of Barrel Rolls "Go to MasterSbilt."
102) The Oil and Water is Pouring Out of your Engine because of a Cracked Block "Go to Hixson Engines."
103) Through a Rod out of the Oil Pan "Go to Hixson Engines."
104) Broke a Wrist Pin "Go to Hixson Engines."

LIST OF REFERENCE NUMBERS

12: game board
14: simulated race course on 12
16: racing groove in 14
18: playing space in 16
20: starting position on 12
21: halfway point stripe on 12
**21*a*: turn four stripe on 12**
22: finish line on 12
24: playing piece
26: spinner
28: mini race car for 24
30: lap counter
32: play money
34: pit area on 12
36: repair shop location on 12
38: victory circle location on 12
39: scale location on 12
40: simulated check for one million dollars
42: indicia in 18
44: pit pass card
45: exemption card
46: sponsor card/new sponsor amount/major sponsor amount
48: trophy
50: instruction booklet
51: numbers "1 to 104" for 42
**51*a*: list for 51 on 12**
52: words "say no to drugs" for 42
54: new sponsor symbol for 42
56: major sponsor symbol for 42
58: racer choice symbol for 42
59: letter "C"—catch the leader for 42
**59*a*: arrow for 42**
**59*b*: words—sponsor name and amount of money for 42**
60: stop watch
62: MPH chart
64: selection of trading cards It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An auto racing board game which comprises:

a) a game board having a simulated race course thereon, with a plurality of adjacent racing grooves, each said racing groove divided into a plurality of sequential playing spaces and having a starting position, a halfway point stripe, a turn four stripe and a finish line;

b) a plurality of playing pieces, each representing a player for movement along said race course from the starting position to the finish line, said game board further includes a pit area, a plurality of repair shop locations, a victory circle location and a scale location;

c) a spinner for randomly choosing the movement each said playing piece along said race course on said game board, each said playing piece is a mini race car;

d) a lap counter to indicate the location of each said mini race car in its lap along said race course on said game board;

e) play money used during the play of said game for each player; and f) said game board further includes a pit area, a plurality of repair shop locations, a victory circle location and a scale location, a simulated check for one million dollars presented to the player that wins said game at said victory circle location on said game board;

g) a plurality of pit pass cards, in which two are given to each player, so that each can be used to enter said pit area on said game board, during the play of said game;

h) a plurality of exemption cards, in which two are given to each player, so that each can be used to prevent a player from doing whatever the playing space they land on indicates;

i) a plurality of sponsor cards used by each player, so that a sponsor can be chosen by each player, during the play of said game;

j) a trophy presented to the player that wins said game at said victory circle location on said game board;

k) an instruction booklet to provide the rules of said game to each player, said game board further includes indicia located within each of said playing spaces to provide information to each player for playing said game, most of said indicia in most of said playing spaces on said game board are a plurality of numbers, each corresponding to a list on said game board indicating various things that can happen during said game;

l) most of said indicia in most of said playing spaces on said game board are a plurality of numbers, each corresponding to a list on said game board indicating various things that can happen during said game, said indicia in one of said playing spaces on said game board are the words "say no to drugs", so that when a player lands on said playing space and says "I will always say no to drugs", the player will receive thirty thousand dollars of said play money, some of said indicia in some of said playing spaces on said game board are symbols indicating new sponsors, so that a player must draw a sponsor card and collect the amount of money said sponsor card lists, some of said indicia in some of said playing spaces on said game board are symbols indicating major sponsors, so that a player must draw a sponsor card and collect the amount of money said sponsor card lists, some of said indicia in some of said playing spaces on said game board are symbols indicating racers choices, giving the players four options, some of said indicia in some of said playing spaces on said game board are the letter "C" indicating catch the leader, wherein some of said indicia in some of said playing spaces on said game board are arrows indicating that a player may choose a different groove, some of said indicia in some of said playing spaces on said game board are words indicating a sponsor name and amount of money, a stop watch, an MPH chart and a selection of trading cards, which could be utilized to introduce said game to the public.

2. An auto racing, board game as recited in claim 1, wherein some of said indicia in some of said playing spaces on said game board indicate a player must "Take a Chance", so that when landing on said playing space that reads "Take a Chance" the player must move forward if an even number is spun and backwards if an odd number is spun.

3. An auto racing board game as recited in claim 2, further including buying additional spins for $20,000 of play money, allowing a player to spin said spinner and move several times consecutively during their turn.

* * * * *